United States Patent [19]

Chapman et al.

[11] Patent Number: 4,627,903

[45] Date of Patent: Dec. 9, 1986

[54] ELECTRODE FOR AN ELECTROSTATIC ATOMIZING DEVICE

[75] Inventors: Alan T. Chapman, Atlanta; David N. Hill, Chamblee, both of Ga.

[73] Assignee: Exxon Research & Engineering Company, Florham Park, N.J.

[21] Appl. No.: 401,833

[22] Filed: Jul. 26, 1982

[51] Int. Cl.[4] ..... B05B 5/00; B22F 3/00

[52] U.S. Cl. ..... 204/275; 204/291; 204/293; 75/232; 419/33; 239/704; 361/228

[58] Field of Search ..... 239/704; 361/228; 419/33; 75/232; 204/275, 291, 293

[56] References Cited

U.S. PATENT DOCUMENTS

| | | | |
|---|---|---|---|
| 3,796,673 | 3/1974 | Clark | 252/515 |
| 4,103,063 | 7/1978 | Hulse | 415/212 |
| 4,155,758 | 5/1979 | Evans et al. | 419/35 |
| 4,231,796 | 11/1980 | Clark et al. | 419/19 |
| 4,255,777 | 3/1981 | Kelly | 239/704 |
| 4,386,960 | 6/1983 | Iacovangelo et al. | 419/35 |

FOREIGN PATENT DOCUMENTS 1505874 8/1975 United Kingdom .

OTHER PUBLICATIONS

Hot-Pressed Eutectics of Oxides and Metal Fibers, N. Claussen, Journal of the American Ceramic Society--Discussions & Notes—vol. 56, No. 8, p. 442.

Metalized-Ceramic/Metal Composites, H. W. Lavendel et al, Ceramic Bulletin, Society Symposia, p. 424.

Wetting Characteristics of Zr with $ZrO_{2-x}$, A. V. Virkar et al, Journal of the American Ceramic Society--Discussions & Notes, Jan.-Feb. 1977, p. 85.

The Fabrication of Components from Aluminum Reinforced with Silica Fibres, P. W. Jackson, et al, Powder Metallurgy, 1968, vol. 11, No. 21, pp. 1-22.

Five Ways to Fabricate Metal Matrix Composite Parts, J. A. Alexander, Materials Engineering, Jul. 1968, pp. 58, 59, 61 & 63.

Fracture Behavior of $ZrO_2$—Zr Composites, A. V. Virkar et al, Journal of the American Ceramic Soc-.—vol. 60, No. 11-12, Nov.-Dec. 1977, pp. 514-519.

In Situ Deposition of Metal Coatings, C. S. Morgan, Thin Solid Films 39 (1976) 305-311.

The Fabrication and Properties of Nickel-Alumina Cerments, P. D. Djali et al, pp. 113-126.

Ceramic-Metal Composites by Reactive Hot Pressing, A. C. D. Chaklader et al, Transactions of the Metallurgical Society of AIME, vol. 233, Jul. 165, pp. 1440-1442.

Feeny et al, "High-Field Electron Emission from Oxide-Metal Composite Materials", Journal of Applied Physics, vol. 46, #4, Apr. 1975, pp. 1841-1843.

*Primary Examiner*—Teddy S. Gron
*Assistant Examiner*—Anne Brookes
*Attorney, Agent, or Firm*—Richard E. Nanfeldt

[57] ABSTRACT

This invention relates to the fabrication of an improved electrode for an electrostatic atomizing device. The electrode consists of metal oxide-metal composite fragments dispersed and bonded in a metallic matrix. The composite fragments contain submicron metallic fibers uniformally arrayed in a nonconducting (insulating) matrix. The electrostatic atomizing device includes a cell having a chamber disposed therein, a discharge spray means in communication with the cell, at least two electrodes disposed in the chamber and being in liquid contact with the liquid in the chamber, the liquid in the chamber being transported to the discharge spray means and atomized into droplets, and a mechanism for generating by means of the electrodes, a charge through the liquid within the chamber, wherein the charge enamating from the improved electrode is sufficient to generate free excess charge in the liquid within the chamber, and the liquid is atomized into droplets.

3 Claims, 1 Drawing Figure

ELECTRODE FOR AN ELECTROSTATIC ATOMIZING DEVICE

BACKGROUND OF THE INVENTION

The technical and patent literature contains many references to the inclusion of a nonmetallic ceramic component in a metal matrix and often the several phase structure is termed a composite material. U.S. Pat. No. 4,103,063 describes the formation of a ceramic-metallic eutectic structural material which is solidified from the melt and possesses oxidation resistant constituents. British Pat. No. 1,505,874 describes the fabrication of an electrically conductive composite material for use in high current electrical contacts. The contacts consist of silver with cadmium oxide and up to 2000 ppm potassium compounds. The oxide serves to help break the arc formed when contact is made and the cadium and potassium vapors serve to reduce the electron energy in the short duration arc.

Nickel-alumina cermets where fabricated by P. D. Djali and K. R. Linger (Proc. British Ceram. Soc., July 26, 1978, pp. 113–127) by hot-pressing alumina powder precoated with nickel to promote bonding between the particles. Near theoretical dense compacts were obtained with average mechanical properties. In similar work, C. S. Morgan used in situ deposition of metal coatings (Thin Solid Films, 39, December 1976, pp. 305–311) to coat ceramic powders and promote the wetting of the ceramic component. Using this approach, an $Eu_2O_3$ powder was coated with W and hot-pressed to form a composite with improved thermal conductivity and improved thermal shock resistance for possible neutron absorbers for reactor use.

In yet another method to promote bonding between ceramic and metal powders, A. C. D. Chaklader and M. N. Shetty formed ceramic-metal composites by reactive hot pressing (Trans. Metal. Soc. Of AIME, 33, July 1965, pp. 1440–42). In their work, a monohydrate of $Al_2O_3$ (Boehmite) was mixed with several metal powders and the "enhanced" reactivity of the $Al_2O_3$ during decomposition used to promote interparticle bonding. A. V. Virkau and D. L. Johnson studied the fracture behavior of $ZrO_2$—Zr composites (J. Am. Cer. Soc., 60, Jan–Feb 1977, pp. 514–19) fabricated by hot-pressing pure $ZrO_2$ and Zr powders in graphite dies at 1600° C. Crack propagation was studied, as influenced by the residual stresses retained in these composites. Alternate methods of forming composites were reported by J. A. Alexander in the article entitled, "Five Ways to Fabricate Metal Matrix Composite Parts, (Materials Engineering, 68, July 1968, pp. 58–63). All of these composites contained filaments (i.e., boron or silicon carbide) and the metal was incorporated by methods ranging from liquid metal infiltration to powder metallurgy techniques.

In the only known reference where previously prepared metal oxide-metal eutectic materials were crushed and recemented together, N. Clausing (J. Am. Cer. Soc., 56, Aug. 1973, p. 197) hot-pressed $Gd_2O_3$—Mo and $(Cr,Al)_2O_3$—Cr composite fragments to form mechanical test specimens. The work-of-fracture of these materials was significantly increased because of the ductile nature of the metallic fibers.

From this extensive background review, the present electrode material is unique simply because no previous effort has been made to form an electrode from this choice of starting materials (i.e., metal oxide-metal composite fragments and pure metallic powders).

SUMMARY OF THE INVENTION

This invention relates to an improved electrode for an electrostatic atomizing device and a process thereof for the formation of the electrode, wherein the electrostatic atomizing device includes a cell having a chamber disposed therein, a discharge spray means in communication with the cell, at least two electrodes disposed in the chamber and being in liquid contact with the liquid in the chamber, the liquid in the chamber being transported to the discharge spray means and atomized into droplets, and a mechanism for generating by means of the electrodes, a charge through the liquid within the chamber, wherein the charge is sufficient to generate free excess charge in the liquid within the chamber, and the improved electrode is unique insofar as it exhibits the properties of a composite metal, metal-oxide eutectic emitter and the mechanical properties of a metal. Inexpensive emitters can be formed by powder metallurgical techniques. This has the subsidiary advantage of high utilization of the composite metal, metal-oxide ingot.

GENERAL DESCRIPTION OF THE INVENTION

The electrostatic charging device containing the improved electrode of the instant invention includes a cell having a chamber therein with a discharge spray means disposed at one end of the cell, wherein the liquid to be atomized is disposed within the chamber and is emitted as charged particles from the discharge spray means. A charge which is sufficient to generate a free excess charge in the liquid is passed through the liquid within the chamber by means of the improved electrodes being in liquid contact with the liquid within the chamber. The convective flow velociity of the liquid within the chamber is the same or different than the mobility controlled current flow velocity within the chamber, thereby permitting the excess free energy charge to be effectively transported to the discharge spray means.

The current source usable for producing the charge means within the chamber of the cell can be a direct voltage, an alternating voltage, or a pulsed voltage source and mixtures thereof of about 100 volts to about 100 kilovolts, more preferably about 100 volts to about 50 kilovolts DC, most preferably about 100 volts to about 30 kilovolts DC. The charge induced into the liquid wiithin the cell can be colinear or at an angle of intersection to the convective flow velocity of the liquid within the chamber, wherein the convective flow velocity of the liquid can be less than, equal to, or greater than the mobility controlled current flow velocity of the charge within the cell. The induced electrical charge introduced into the liquid within the cell must be sufficient to generate free excess charge in the liquid within the chamber, wherein the charge can be negative or positive.

The formed droplets existing from the discharge spray means can be accelerated outwardly from the discharge spray means without any substantial stagnation, or emitted from the discharge spray means in a swirl configuration, or emitted from the discharge spray means in a planar configuration. The formation of the charged droplets can occur either within the spray discharge means or externally thereto.

DESCRIPTION OF THE PREFERRED EMBODIMENTS

Figure 1:
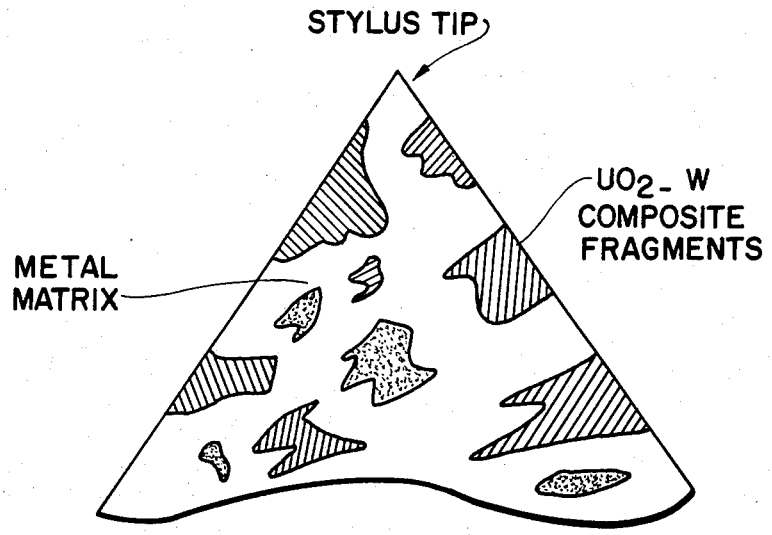

FIG. 1 shows the electrostatic atomizing device of the instant invention includes the improved electrodes which include a cylindrically shaped non-conductive housing (cell) (e.g. Lucite) having a base, and upwardly extending cylindrically shaped sidewall with a threaded aperture therethrough, a top with a threaded aperture therethrough and a threaded hole therethrough, and a chamber disposed therein, wherein the base has a center discharge opening therethrough which is the discharge spray means. One threaded end of a first cylindrically shaped liquid supply conduit is threadably received into the threaded hole of the housing, wherein the conduit extends linearly outwardly from the top of the housing. The other threaded end of the conduit is adapted to be joined to a liquid supply means whereby the liquid passes through conduit into the chamber of the housing, wherein the liquid has a conductivity of less than about $10^{-4}$ mho/meter, more preferably less than about $10^{-8}$ mho/meter, and most preferably less than about $10^{-10}$ mho/meter, e.g., No. 2 grade heating oil. A first nonconductive, elongated, cylindrically shaped tube having an externally threaded surface and a continuous bore therethrough is threadably disposed therethrough threaded aperature of the housing, wherein one end of the first nonconductive elongated cylindrically shaped tube extends outwardly from the housing and the other end of the first nonconductive elongated cylindrically shaped tube extends inwardly into an upper portion of chamber of the housing 26. A first electrode, or a series of first electrodes, in parallel, or in a parallel series combination, is joined into the other end of the first nonconductive elongated cylindrically shaped tube by suitable means such as an adhesive cement or the end of the first nonconductive elongated cylindrically shaped tube can be embedded into electrode. The first electrodes of the instant invention are formed from a blend mixture of two components, metal oxide-metal composite particles and metal powders. The composite particles typically contain between $10^6$ and $5\times10^7$ aligned, submicron diameter, metallic fibers per $cm^2$ uniformly embedded in an electrically insulating (oxide) matrix. The composite can be fabricated by well-known prior art techniques. One fabrication approach which can be utilized is described in detail in the publication "Report No. 6: Melt Grown Oxide-Metal Composites" from the School of Ceramic Engineering, Georgia Institute of Technology, A. T. Chapman, Project Director (December 1973) hereby incorporated by reference, detailing fabrication of a melt grown metal oxide-metal composite. It is well-known that electron field emission can be stimulated from a single tip or plurality of small metallic points either flush with an insulating matrix or disposed above the matrix, and the metal oxide-metal composite particles provide this spatial geometry. The composite structures have been used to obtain electron field emission under high vacuum conditions as described, for example, by Feeney, et al., in Journal of Applied Physics, Vol. 46, No. 4, April 1975, pp. 1841–43, entitled "High-Field Electron Emission from Oxide-Metal Composite Materials". The composite particles may be selected but not limited to systems such as $UO_2$—W, $Gd_2O_3(CeO_2)$—Mo, $ZrO_2(Y_2O_3)$—W, $CeO_2$—Mo. The electrically conducting and connecting metal matrix may be composed but not limited to Cu, Co, or Ni, or combinations of these metals. The reconstructed metal oxide-metal cermet is designated ROMC in the following description.

To prepare the ROMC material, the crushed and sized metal oxide-metal fragments are simply blended with desired amounts of metallic powder(s). The volume fraction of the composite particles may be between 10 and 80 percent. The composite metal powder mixture is compacted to consolidate the blend using pressure and/or temperature to form disc shaped material. The disc of the blend mixture is cut into square shaped bars which are subsequently machined into the desired cylindrical shaped electrodes. The composite blend mixture permits machining of the electrode into any desired shape by conventional machinery methods whereas conventional electrodes are formed by a more costly and complicated process. The first electrode is connected in series to a high voltage source which is disposed externally to the housing, by means of a first electrical lead wire extending through the bore of the first nonconductive elongated cylindrically shaped tube. The high voltage source is wired by means of a ground wire to a ground disposed externally to the device. A second nonconductive (e.g. Lucite) elongated cylindrically shaped tube having a continuous bore therethrough is disposed through aperture 21, wherein one end of the second nonconductive elongated cylindrically shaped tube extends outwardly from housing and the other end of the second nonconductive elongated cylindrically shaped tube extends inwardly into a lower portion of the chamber of the housing. A liquid-tight seal is formed between the second nonconductive elongated cylindrically shaped tube and the sidewall of the housing by adhesive or other sealant means. A second electrode, or a series of second electrodes in parallel or in series, parallel combination are joined onto the end of the second nonconductive elongated cylindrically shaped tube by suitable means such as an adhesive cement or the end of the second nonconductive elongated cylindrically shaped tube can be embedded in the second electrode. The second electrode is a planar shaped disc having at least one center longitudinally aligned aperture therethrough and optionally a plurality more of longitudinally aligned aperture therethrough at prescribed distances from the center aperture; alternately a plurality of longitudinally aligned apertures could be used arrayed symmetrically with respect to the center line with no aperture hole on the center line. The aperture holes could also be skewed to the center line. The second electrode is disposed transversely within chamber of the housing below and spaced apart from the first electrode. The first electrode can be moved longitudinally upward or downward thereby reducing or increasing the gap between the first and second electrodes, as well as modifying the flow of charge within the liquid. The second electrode is preferably formed from platinum, nickel or stainless and is wired in series to a high voltage resistor element disposed externally to the housing by an electrical lead wire extending through the second nonconductive elongated cylindrically shaped tube. The resistor element is connected at its opposite end to ground juncture of the high voltage source. An external annularly shaped electrode (e.g. stainless steel) can be affixed on the external bottom surface of base of the housing by adhesive means or by a plurality of anchoring elements extending upwardly through the annularly shaped electrode and being embedded into base of the housing. The center opening of the annularly shaped electrode and discharge opening in the base of the housing are aligned, wherein the opening in the base of the housing is preferably less than about 2 cm in diameter, more preferably less than about 1 cm in diameter, most preferably less than about 6 microns in diameter, and the diameter of the center opening of the annularly shaped electrode is less than about 1 mm, more preferably less than about 600 μ m, and most preferably less than about 200 μm. In this position, the annularly shaped electrode assists the spraying due to the development of the electrostatic field; however, the positioning of the annularly shaped electrode at this position is not critical to operating as long as this the annularly shaped electrode is disposed external to the housing. The annularly shaped electrode is also connected to a second grounded junction disposed between the ground and the first electrical juncture. The first electrode is negatively charged wherein the second electrode, has a relative positive potential with respect to the first electrode and the external annularly shaped electrode is at ground potential. In one mode of operation, the first electrode is negatively charged and the second electrode and the external annularly shaped electrode are relatively positively charged. The high voltage source, which can be a direct voltage, an alternating voltage, or a pulsed voltage source of either polarity, wherein the source is about 100 volts to about 100 kilovolts, more preferably about 100 volts to about 50 kilovolts DC, and more preferably about 100 volts to about 30 kilovolts DC. The charge induced into the liquid within the chamber of the housing results in a flow from the first electrode to the second electrode. The liquid within the chamber of the housing flows towards the discharge opening of the base of the housing, wherein the electrical charge which is induced into the liquid within the chamber of the housing must be sufficient to generate excess free charge in the liquid within the chamber of the housing, wherein the charge can be positive or negative. The liquid is emitted outwardly therefrom in a spray configuration, (as a plurality of droplets), wherein the external annularly shaped electrode enhances acceleration of the charged droplets.

EXPERIMENTAL RESULTS OF THE PREFERRED EMBODIMENT OF THE INVENTION

The following examples are intended to provide sufficient experimental data for a complete understanding of the instant invention, but are not to be construed as either limiting the spirit or scope of the invention. A description of three procedures that were employed to manufacture prototype reconstructed metal oxide-metal composites, ROMC, electrodes is detailed below. The first method (Example I) describes the use of direct induction heating to form the cermet-type electrode, the second method (Example II) describes the hot-pressing of the composite-metal ROMC material in graphite dies, and the third method (Example III) describes the direct bonding of the ROMC material on a metal pin during hot pressing.

EXAMPLE I

Step 1. A previously grown 3.1 cm diameter $UO_2$-W ingot was sliced transversely to yield wafers about 2 mm thick. The unmelted skin was removed from these wafers using a diamond saw.

Step 2. The core region of the $UO_2$—W wafers was hand-crushed in porcelain mortar and pestle and screened until about three grams of composite fragments passed through a 325 mesh screen (yielding composite powder less than 44 μm in diameter).

Step 3. The composite fragments and copper powder (−325 mesh) were weighed separately to provide three grams of each material and hand-mixed in a mortar and pestle. From the resultant ROMC mixture, two grams were loaded into a ⅜" diameter steel punch and die set and compacted at 2000 psi.

Step 4. The pressed ROMC disc was placed on a ceramic support (foamed, fused silica) and loaded into a glass tube for the direct induction heating of the sample. The glass tube was evacuated and filled with an $N_2/H_2$ atmosphere (10/1 molecular ratio). The wafer was heated by a 10 kw rf generator operating at 4 mHz by increasing the power until the temperature of the surface of the ROMC disc reached 900° C., as measured by an optical pyrometer. The initial heating required about 30 minutes. The ROMC disc was held at 900° C. for 150 minutes and then cooled to room temperature for an additional 30 minutes.

Step 5. The consolidated ROMC disc was cut into square shaped bars (~3 mm×~3 mm×~9 mm) using a silicon carbide saw. The ROMC bars were mounted in a 4 jaw chuck of a lathe and ground to a stylus shaped geometry using a rotating SiC grinding wheel.

EXAMPLE II

Step 1. A previously grown 3.1 cm diameter $UO_2$—W ingot was sliced transversely to yield wafers about 2 mm thick. The unmelted skin was removed from these wafers using a diamond saw.

Step 2. The core region of the $UO_2$—W wafers was hand-crushed in a porcelain mortar and pestle and screened until 15 grams of the composite fragments passed through a 200 mesh screen (yielding composite powder less than 75 μm in diameter).

Step 3. Fifteen grams of a metal mixture consisting of five grams each of −325 mesh copper, nickel and cobalt powders were blended and mixed by hand in a mortar and pestle.

Step 4. The $UO_2$—W composite fragments and metal mixture (15 grams of each) was hand-mixed in a mortar and pestle and loaded into a ½" diameter steel punch and die set and compacted at 2000 psi.

Step 5. The pressed ROMC disc was placed into a graphite die ½" inside diameter and placed inside a silica tube for hot pressing. The sample was heated to approximately 1000° C. in 15 minutes and held at 2000 psi at this temperature for 60 minutes. After 75 minutes, the rf generator was turned off and the sample cooled to room temperature.

Step 6. The compacted and densified ROMC disc was cut into wafers ~3 mm thick. Density measurements indicated the material was approximately 9.0 grams per cc, a value close to 90% of theoretical density. The 3 mm thick wafers were mounted on glass slides and core drilled with a diamond tool to yield cylindrically shaped specimens.

EXAMPLE III

Step 1. A previously grown 3.1 cm diameter $Y_2O_3$ stabilized $ZrO_2$—W (ZYW) ingot was sliced transversely to yield wafers about 2 mm thick. The unmelted skin was removed from these wafers using a diamond saw.

Step 2. The core region of the ZYW wafers was hand-crushed in a porcelain mortar and pestle and screened until 15 grams of the composite fragments passed through a 200 mesh screen (yielding composite powder less than 75 μm in diameter).

Step 3. Fifteen grams of a metal mixture consisting of five grams each of −325 mesh copper, nickel, and cobalt powders were blended and mixed by hand in a mortar and pestle.

Step 4. The ZYW composite fragments and metal mixture (15 grams of each) was hand-mixed in a mortar and pestle and between 100 and 200 milligrams of the blend loaded into a graphite die containing a ⅛" diameter stainless steel pin.

Step 5. The graphite die assembly was placed inside the silica tube, and heated to about 1000° C. in 15 minutes. During heating, the pressure was incrementally increased to pressures up to 20,000 psi. The high pressure was maintained for 60 minutes at 1000° C. After 75 minutes, the rf generator was turned off and the sample cooled to room temperature and the pressure reduced incrementally.

Step 6. The consolidated ROMC material was bonded to the steel pin and cylindrical in shape. The pin with the ROMC end was mounted in a lathe and the stylus shaped electrode was ground with a rotating SiC grinding wheel.

What is claimed is:

1. An improved electrode for an electrostatic atomizing device which comprises a cell having a chamber disposed therein, a discharge spray means in communication with the cell, at least two electrodes disposed in said chamber and being in liquid contact with a liquid in said chamber, and a third electrode disposed externally to said cell and said discharge means, wherein the improved electrode comprises a machined alloy of a blend mixture of a metal oxide-metal composite particle and a metal power, said alloy of said blend mixture formed under heat and pressure, wherein the volume fraction of said metal oxide-metal composite particle is 10 to 80 percent of said blend mixture, wherein said metal oxide-metal composite particles contain between $10^6$ to $5\times10^7$ aligned, submicron diameter, metallic fibers per $cm_2$, wherein said composite particles are selected from the group consisting of $UO_2$—W, $Gd_2O_3(CeO_2)$—Mo, $ZrO_2(Y_2O_3)$—W and $CeO_2$—Mo, wherein said metal powder is selected from the group consisting of Cu, Co, Ni and Ni—Cu—CO and mixtures thereof.

2. A process for forming an electrode for an electrostatic atomizing device which comprises the steps of:

(a) blending a mixture of composite particles and metal powders, wherein the composite material is selected from the group consisting of $UO_2$—W, $Gd_2O_3(CeO_2)$—Mo, $ZrO_2(Y_2O_3)$—W and $CeO_2$—Mo, wherein said metal powders are selected from the group consisting of Cu, Ni, Co, and Ni—Cu—Co and mixtures thereof, and wherein the volume fraction of said composite particles is 10 to 80 percent of said blend mixture;

(b) consolidating said mixture under sufficient heat and pressure;

(c) forming said mixture into a disc;

(d) cutting said disc into a square shaped bar; and (e) machining said square shaped bar into a stylus shaped electrode.

3. A process for forming an electrode for an electrostatic atomizing device which comprises the steps of:

(a) blending a mixture of composite particles and metal powders, wherein the composite material is selected from the group consisting of $UO_2$—W, $Gd_2O_3(CeO_2)$—Mo, $ZrO_2(Y_2O_3)$—W and $CeO_2$—Mo, wherein said metal powders are selected from the groups consisting of Cu, Ni, Co, and Ni—Cu—Co and mixtures thereof, and wherein the volume fraction of said composite particles is 10 to 80 percent of said blend mixture;

(b) consolidating said mixture under sufficient heat and pressure;

(c) bonding said consolidated mixture to an end of a metal pin; and (d) machining said metal pin into a stylus shaped electrode.

* * * * *